US008047877B1

(12) United States Patent
Liu et al.

(10) Patent No.: US 8,047,877 B1
(45) Date of Patent: Nov. 1, 2011

(54) QUICKLY ASSEMBLED UNIVERSAL SERIAL BUS (USB) CONNECTOR

(75) Inventors: Fei Liu, Guang-Dong (CN); Ou Yang, Guang-Dong (CN); Hong-Tu Zhang, Guang-Dong (CN); Ping-Chih Chen, Tu-Cheng (TW); Ming-Chiang Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/880,055

(22) Filed: Sep. 10, 2010

(51) Int. Cl.
*H01R 24/00* (2011.01)
*H01R 33/00* (2006.01)

(52) U.S. Cl. ..... 439/660; 439/732; 439/862

(58) Field of Classification Search ..... 439/660, 439/607.35, 862, 732
See application file for complete search history.

(56) References Cited

U.S. PATENT DOCUMENTS

| | | | | |
|---|---|---|---|---|
| 5,674,085 | A * | 10/1997 | Davis et al. | 439/188 |
| 7,607,926 | B2 * | 10/2009 | Wang | 439/188 |
| D620,444 | S * | 7/2010 | Liu et al. | D13/147 |
| D620,445 | S * | 7/2010 | Yang et al. | D13/147 |
| 7,798,832 | B2 * | 9/2010 | Qin et al. | 439/188 |
| 7,837,510 | B1 * | 11/2010 | Hung et al. | 439/660 |
| 7,922,535 | B1 * | 4/2011 | Jiang et al. | 439/607.35 |

* cited by examiner

*Primary Examiner* — Hae Moon Hyeon
(74) *Attorney, Agent, or Firm* — Cheng-Ju Chiang

(57) ABSTRACT

A USB (Universal Serial Bus) connector includes an insulating body which has a base portion, an inserting portion, and a pair of clipping walls and defines a receiving space therebetween. A plurality of signal terminals is assembled to the insulating body. Each of the signal terminals has a connecting arm disposed in the inserting portion and a signal contacting arm hanging out of the receiving space. A fixing body is mounted in the receiving space and clipped between the clipping walls. The signal contacting arms are restrained under the fixing body and further stretching behind the fixing body. A ground terminal has a fixing slice fixed in the fixing body, a resilient arm stretching out of the fixing body to be located above the inserting portion and a ground contacting arm restrained under the fixing body and further stretched behind the fixing body to be aligned with the signal contacting arms.

11 Claims, 5 Drawing Sheets

QUICKLY ASSEMBLED UNIVERSAL SERIAL BUS (USB) CONNECTOR

BACKGROUND OF THE INVENTION

1. Field of the Invention

The present invention relates to a USB (Universal Serial Bus) connector, and particularly to a USB connector for combining all components thereof together by means of assembly.

2. The Related Art

Nowadays, with the development of electronic technology, electronic products and peripheral devices thereof are connected with each other more and more frequently. One of the main modes of connections between the electronic products and the peripheral devices thereof is achieved by an electrical connector, such as a USB connector.

A conventional USB connector includes an insulating body, a plurality of signal terminals insert-molded in the insulating body and a metal housing enclosing the insulating body. One basic process of producing the USB connector is that pouring melting plastic material into a mold in which the signal terminals are firstly fixed to form the insulating body around the signal terminals. However, during injection molding the insulating body, the signal terminals are apt to be lashed by the melting plastic material and get crooked. As a result, the finished USB connector may be unqualified. Furthermore, the mold for injection molding the insulating body is extremely complicated and the housing is made of metal, so the cost of producing the USB connector is much higher.

SUMMARY OF THE INVENTION

Accordingly, an object of the present invention is to provide a USB connector which includes a base portion, an inserting portion extending forward from a front surface of the base portion, and a pair of clipping walls extending rearwards from two opposite ends of a rear surface of the base portion and defining a receiving space therebetween. A plurality of signal terminals is assembled to the insulating body and spaced from one another along a direction perpendicular to the extension direction of the inserting portion. Each of the signal terminals has a connecting arm passing through the base portion to be disposed in a top surface of the inserting portion and a signal contacting arm hanging out of the receiving space. A fixing body is mounted in the receiving space of the insulating body and clipped between the clipping walls. The signal contacting arms of the signal terminals are restrained under the fixing body and further stretch behind the fixing body. A ground terminal has a fixing slice fixed in the fixing body, a resilient arm and a ground contacting arm formed at two opposite sides of the fixing slice. The resilient arm stretches out of the fixing body to be located above the inserting portion and the ground contacting arm is restrained under the fixing body and further stretches behind the fixing body to be aligned with the signal contacting arms of the signal terminals.

As described above, the USB connector includes the insulating body, the fixing body, the signal terminals, and the ground terminal, and is manufactured by assembling the foregoing components together, instead of injection molding the insulating body around the signal terminals in the prior art. Such manner not only can quickly assemble the USB connector, but also can improve the quality of the finished USB connector. Furthermore, the insulating housing is made of insulating material instead of metal, so the cost of producing the USB connector will be accordingly lowered.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
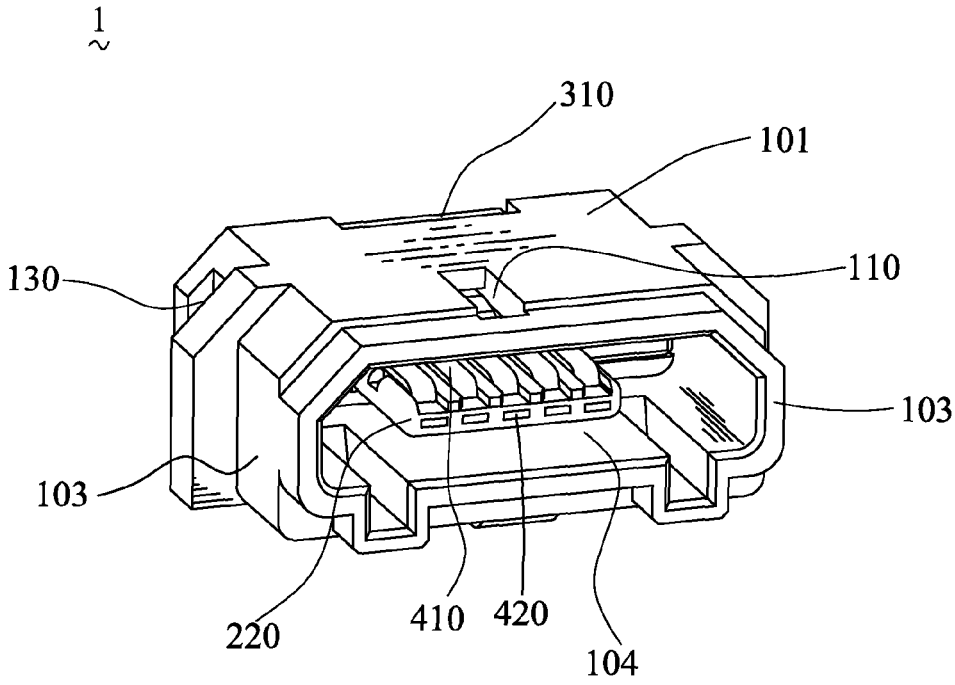
FIG. 1 is an assembled, perspective view of a USB connector of an embodiment in accordance with the present invention.
Figure 4:
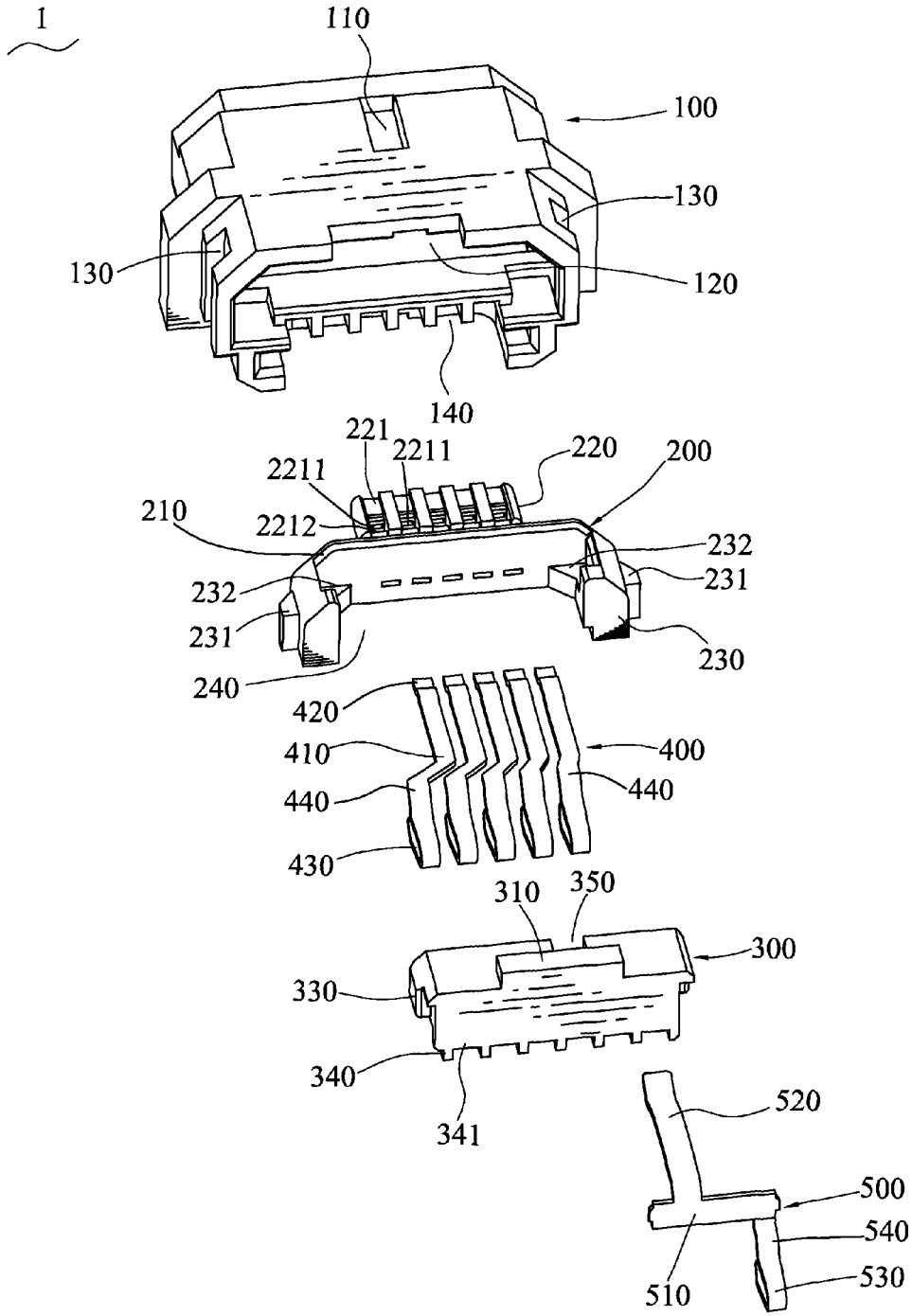
FIG. 4 is an exploded, perspective view of the USB connector shown in FIG. 1.

Referring to the drawings in greater detail, and first to FIG. 1 and FIG. 4, the embodiment of the invention is embodied in a USB connector 1. The USB connector 1 includes an insulating housing 100 and a connecting module which further includes an insulating body 200, a fixing body 300, a plurality of signal terminals 400 and a ground terminal 500.

Figure 2:
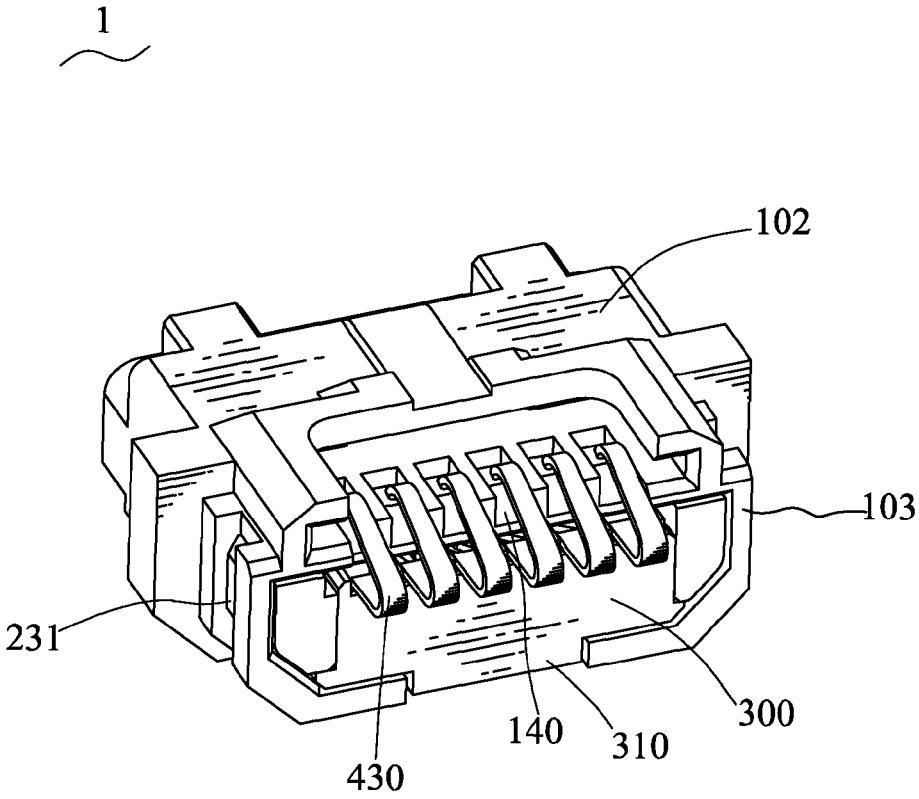
FIG. 2 is an assembled, perspective view of the USB connector of FIG. 1 viewed from another angle.

Referring to FIG. 1, FIG. 2 and FIG. 4, the insulating housing 100 has a top board 101, a bottom board 102, and two opposite side boards 103 connecting the top board 101 with the bottom board 102. The top board 101, the bottom board 102 and the side boards 103 collectively define a receiving chamber 104 for receiving the connecting module therein. An opening 110 is opened at a front of the top board 101 of the insulating housing 100 and communicates with the receiving chamber 104. A rear end of the top board 101 defines a gap 120 communicating with the receiving chamber 104. The side boards 103 respectively define a fixing notch 130 communicating with the receiving chamber 104. A rear end of the bottom board 102 defines a plurality of receiving grooves 140 opposite to the receiving chamber 104 and aligned with one another along a rear edge of the bottom board 102.

Figure 3:
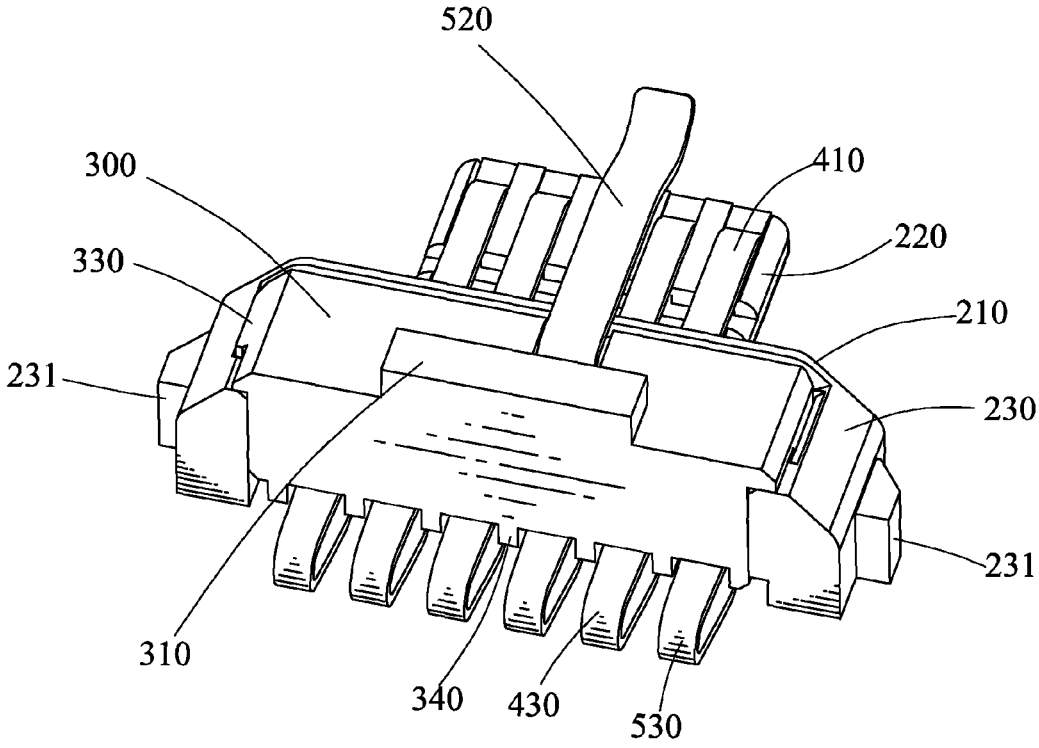
FIG. 3 is an assembled, perspective view of a connecting module of the USB connector shown in FIG. 1.

Referring to FIG. 2, FIG. 3 and FIG. 4, the insulating body 200 has a substantially rectangular base portion 210, an inserting portion 220 extended forwards from a front surface of the base portion 210 and a pair of clipping walls 230 extended rearwards from two opposite ends of a rear surface of the base portion 210. The base portion 210 and the clipping walls 230 corporately define a receiving space 240 for accommodating the fixing body 300 therein. The inserting portion 220 defines a plurality of holes 2212 aligned with one another along a direction perpendicular to the extension direction of the inserting portion 220 and apart from the base portion 210. Each of the holes 2212 vertically passes through the top surface of the inserting portion 220. A bottom end and a top end of the hole 2212 oppositely extend along a front-to-rear direction to form an inserting slot 2211 and a terminal groove 221 opened in the top surface of the inserting portion 220 and further penetrating through the base portion 210. Two opposite outsides of the pair of clipping walls 230 oppositely protrude outward to form a wedge-shaped fixing block 231 respectively. Two insides of the pair of clipping walls 230 respectively define a recess 232 adjacent to the rear surface of the base portion 210 and penetrating through a top of the respective clipping wall 230.

Figure 5:
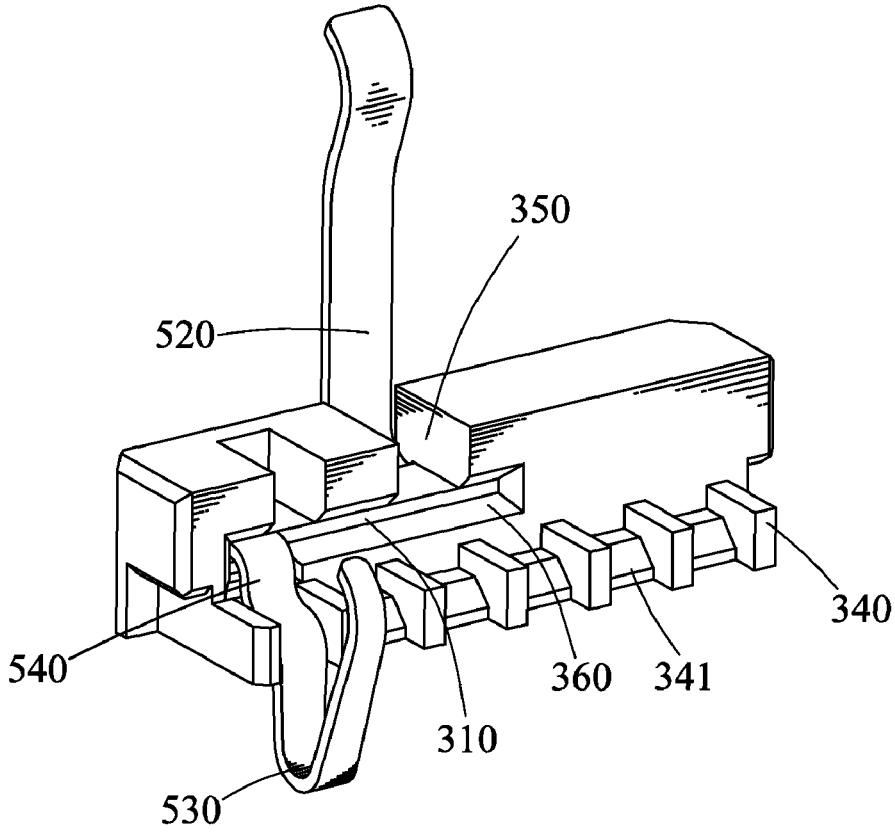
FIG. 5 shows a relationship between a ground terminal and a fixing body of the connecting module of FIG. 3.

Referring to FIG. 3, FIG. 4 and FIG. 5, the fixing body 300 is of substantially rectangular shape and has a preventing projection 310 protruded upward from a middle of a rear end of a top surface of the fixing body 300 for being secured in the gap 120 of the insulating housing 100. Two opposite sides of the fixing body 300 oppositely protrude outward to form a pair of protrusions 330 at fronts thereof. A rear end of a bottom surface of the fixing body 300 protrudes downward to form a plurality of restraining blocks 340 spaced from and aligned with one another along a transverse direction thereof. A propping block 341 is connected between upper portions of each two adjacent of the restraining blocks 340. A passage 350 is opened in a front of the fixing body 300 and vertically penetrates through the fixing body 300. The fixing body 300 further defines a fixing slot 360 extending transversely between the restraining blocks 340 and the passage 350, and further passing through the bottom surface thereof. The passage 350 is connected with a portion of a front of the fixing slot 360.

Referring to FIG. 2 and FIG. 4, the signal terminal 400 has a strip-shaped connecting arm 410 and a signal contacting arm 430 connected with a rear end of the connecting arm 410 in a step manner by a first restraining portion 440. The signal contacting arm 430 is of substantial lying-V shape with the mouth thereof facing forward, and has a distal end slightly bent towards the first restraining portion 440. A front end of the connecting arm 410 is bent downward and extends forward to form an inserting tail 420.

The ground terminal 500 has a long rectangular fixing slice 510, a strip-shaped resilient arm 520 extended forward and inclined upward from a portion of a top edge of the fixing slice 510, and a substantially lying-V shaped ground contacting arm 530 connected with a portion of a bottom edge of the fixing slice 510 in a step manner by a second restraining portion 540. The second restraining portion 540 and the resilient arm 520 are located at two opposite sides of the fixing slice 510, and the mouth of the ground contacting arm 530 faces forward. The ground contacting arm 530 has a distal end slightly bent towards the second restraining portion 540 for being received in the corresponding receiving groove 140. A free end of the resilient arm 520 of the ground terminal 500 is further arched downward.

Referring to FIGS. 1-5, in assembly, the signal terminals 400 are fixed in the insulating body 200, with the inserting tail 420 being inserted forward in the inserting slot 2211 through the corresponding hole 2212, and the connecting arm 410 being disposed in the terminal groove 221 of the inserting portion 220. The first restraining portion 440 stretches in the receiving space 240 to make the signal contacting arm 430 hang out of the receiving space 240. The fixing slice 510 of the ground terminal 500 is fixed in the fixing slot 360 of the fixing body 300, with the resilient arm 520 passing through the passage 350 and projecting beyond the front of the fixing body 300. The second restraining portion 540 is located under the fixing body 300 and against one of the propping blocks 341 to make the ground contacting arm 530 pass through the adjacent two of the restraining blocks 340 and project behind the fixing body 300. The fixing body 300 with the ground terminal 500 is fixed in the receiving space 240 of the insulating body 200 by means of the protrusions 330 being buckled in the recesses 232. The first restraining portions 440 of the signal terminals 400 are restrained under the fixing body 300 and against the corresponding propping blocks 341. The signal contacting arms 430 each pass through the corresponding adjacent two restraining blocks 340 and further project behind the fixing body 300 in alignment with the ground contacting arm 530. The resilient arm 520 of the ground terminal 500 is elastically located above the inserting portion 220 of the insulating body 200. Thereby, the assembly of the connecting module can be accomplished. Then, the connecting module is received in the receiving chamber 104 of the insulating housing 100. The fixing block 231 and the preventing projection 310 are respectively fixed in the fixing notch 130 and the gap 120. The distal ends of the signal contacting arm 430 and the ground contacting arm 530 are elastically received in the receiving grooves 140 respectively. The free end of the resilient arm 520 of the ground terminal 500 can be elastically pressed into the opening 110 of the insulating housing 100 by means of contacting with a metal housing (not shown) or another ground terminal of a complementary connector (not shown).

The fixing block 231 and the preventing projection 310 are respectively fixed in the fixing notch 130 and the gap 120, so the connecting module can be firmly fixed in the receiving chamber 104 of insulating housing 100 and stably connect with the complementary connector. Furthermore, the signal contacting arm 430 and the ground contacting arm 530 each are partially confined between the restraining blocks 340, such structure can avoid the contacting arms 430, 530 being excessively biased sideward and further ensure the contacting arms 430, 530 exactly connecting with a printed circuit board (not shown) when the USB connector 1 is mounted on the printed circuit board.

As described above, the USB connector 1 includes the insulating body 200, the fixing body 300, the signal terminals 400, and the ground terminal 500, and is manufactured by assembling the foregoing components together, instead of injection molding the insulating body around the signal terminals in the prior art. Such manner not only can quickly assemble the USB connector 1, but also can improve the quality of the finished USB connector 1. Furthermore, the insulating housing 100 is made of insulating material instead of metal, so the cost of producing the USB connector 1 will be accordingly lowered.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A USB (Universal Serial Bus) connector, comprising:

an insulating body having a base portion, an inserting portion extending forward from a front surface of the base portion, and a pair of clipping walls extending rearwards from two opposite ends of a rear surface of the base portion and defining a receiving space therebetween;

a plurality of signal terminals assembled to the insulating body and spaced from one another along a direction perpendicular to the extension direction of the inserting portion, each of the signal terminals having a connecting arm passing through the base portion to be disposed in a top surface of the inserting portion, and a signal contacting arm hanging out of the receiving space;

a fixing body mounted in the receiving space of the insulating body and clipped between the clipping walls, the signal contacting arms of the signal terminals being restrained under the fixing body and further stretching behind the fixing body; and a ground terminal having a fixing slice fixed in the fixing body, a resilient arm and a ground contacting arm formed at two opposite sides of the fixing slice, the resilient arm stretching out of the fixing body to be located above the inserting portion, and the ground contacting arm being restrained under the fixing body and further stretching behind the fixing body to be aligned with the signal contacting arms of the signal terminals.

2. The USB connector as claimed in claim 1, wherein two insides of the pair of clipping walls respectively define a recess penetrating through a top of the respective clipping wall, a pair of protrusions oppositely protrudes outward from two opposite sides of the fixing body and is fixed in the corresponding recesses.

3. The USB connector as claimed in claim 1, wherein the inserting portion defines a plurality of holes aligned with one another apart from the base portion and each vertically passing through the top surface of the inserting portion, a bottom end and a top end of the hole oppositely extend along a front-to-rear direction to form an inserting slot and a terminal groove opened in the top surface of the inserting portion and further penetrating through the base portion, a front end of the connecting arm is bent downward and then extends forward to from an inserting tail, the connecting arm is disposed in the terminal groove and the inserting tail is inserted forward in the inserting slot through the corresponding hole.

4. The USB connector as claimed in claim 1, wherein the signal contacting arm is connected with a rear end of the connecting arm in a step manner by a first restraining portion, the ground contacting arm is connected with a bottom edge of the fixing slice in a step manner by a second restraining portion, the first and second restraining portions are restrained under the fixing body to strengthen the signal and ground contacting arms.

5. The USB connector as claimed in claim 4, wherein a bottom surface of the fixing body protrudes downward to form a plurality of restraining blocks spaced from and aligned with one another, a propping block is connected between upper portions of each two adjacent of the restraining blocks, the restraining portion is against the corresponding propping block and each contacting arm is partially confined between adjacent two restraining blocks.

6. The USB connector as claimed in claim 1, wherein the resilient arm of the ground terminal is formed by extending forward and inclined upward from a top edge of the fixing slice, the fixing body defines a fixing slot extending transversely and passing through a bottom surface thereof, a passage is opened in a front of the fixing body and vertically penetrates through the fixing body, the passage is connected with a portion of a front of the fixing slot, the resilient arm passes through the passage to make the fixing slice inserted upward in the fixing slot.

7. The USB connector as claimed in claim 1, further comprising an insulating housing which has a top board, a bottom board, and two opposite side boards connecting the top board with the bottom board to collectively define a receiving chamber thereamong, the insulating body and the fixing body with the signal terminals and the ground terminal being fixed in the receiving chamber of the insulating housing.

8. The USB connector as claimed in claim 7, wherein two insides of the side boards respectively define a fixing notch communicating with the receiving chamber, two opposite outsides of the pair of clipping walls of the insulating body oppositely protrude outward to form two fixing blocks buckled in the fixing notches respectively.

9. The USB connector as claimed in claim 7, wherein a rear end of the top board defines a gap communicating with the receiving chamber, a preventing projection protrudes upward on the fixing body and is buckled in the gap.

10. The USB connector as claimed in claim 7, wherein the signal contacting arm and the ground contacting arm each are of substantially lying-V shape and have a distal end bent inward, a rear end of the bottom board defines a plurality of receiving grooves opposite to the receiving chamber and aligned with one another for receiving the distal ends of the contacting arms therein.

11. The USB connector as claimed in claim 7, wherein an inside of the top board defines an opening communicating with the receiving chamber, a free end of the resilient arm of the ground terminal is arched towards the inserting portion and can be pressed into the opening.

* * * * *